US005509626A

United States Patent [19]

Fodor

[11] Patent Number: 5,509,626

[45] Date of Patent: Apr. 23, 1996

[54] RAILROAD TRACK SWITCH

[75] Inventor: Andreas Fodor, Enzesfeld, Austria

[73] Assignee: Enzesfeld-Caro Metallwerke AG, Enzesfeld, Austria

[21] Appl. No.: 345,700

[22] Filed: Nov. 21, 1994

[30] Foreign Application Priority Data

Nov. 19, 1993 [DE] Germany ..... 93 17 723.2

[51] Int. Cl.[6] ..... E01B 7/00

[52] U.S. Cl. ..... 246/453; 246/443; 246/448

[58] Field of Search ..... 246/415 R, 430, 246/435 R, 442, 443, 447, 448, 453; 384/418, 477

[56] References Cited

U.S. PATENT DOCUMENTS

| | | | |
|---|---|---|---|
| 1,943,998 | 1/1934 | Adams | 384/418 |
| 1,965,803 | 7/1934 | Post et al. | 246/435 R |
| 5,390,881 | 2/1995 | Benenowski et al. | 246/453 |

FOREIGN PATENT DOCUMENTS

| | | | |
|---|---|---|---|
| 375697 | 8/1984 | Austria . | |
| 0532860A1 | 7/1992 | European Pat. Off. . | |
| 1658366 | 10/1970 | Germany | 246/442 |
| 4041264A1 | 6/1992 | Germany . | |
| 4224158A1 | 1/1994 | Germany . | |
| 368201 | 5/1963 | Switzerland | 246/453 |
| 114278 | 3/1918 | United Kingdom | 246/453 |
| 1122143 | 7/1968 | United Kingdom | 384/418 |
| 9402682 | 2/1994 | WIPO | 246/415 R |

*Primary Examiner*—Robert J. Oberleitner
*Assistant Examiner*—S. Joseph Morano
*Attorney, Agent, or Firm*—Jacobson, Price, Holman & Stern

[57] ABSTRACT

A railroad track switch has tongue rails which pivot relative to fixed stock rails and rolls onto which the tongue rails move when pivoted away from the stock rails. The rolls are carried at opposite ends in spring supports and each roll is mounted for level adjustments in the respective supports. Outer ends of the spring supports are themselves mounted for back and forth adjustments towards and away from the stock rails.

15 Claims, 1 Drawing Sheet

RAILROAD TRACK SWITCH

BACKGROUND OF THE INVENTION

The subject of the invention is a railroad track switch having stock rails and swingable tongue rails.

The parts of a railroad track system which undergo the most stress are the switches. Ordinarily, the rails of a track system must be non-slidably bound to a foundation, which may comprise ties, concrete base elements, or the like; and therefore switches unavoidably have moving parts, namely tongue rails (also called switch tongues). The switch tongues must be brought into an operating position in which they have the same load-bearing capability as the ordinary track rails. The rails of a track system, in order to enable suitable riding comfort simultaneously with high stability under load, must undergo an elastic deflection when stressed by a train; the deflection in the vertical direction may amount to several millimeters. A switch should not act like a foreign body in a track section, but should have the same static and dynamic characteristics as the rest of the track section, allowing for the fact that trains generally pass over switches at a lower speed.

It is generally not difficult to achieve exact positioning of the stock rails, because these can be fixedly attached to the foundation element (e.g. bedplate, ties, or the like). In contrast, because of the greater difficulty of exactly positioning the switch tongues, movable switch tongues require means of supporting them in the operating position. In ordinary switches, "slide chairs" are provided on which the foot of the switch tongue can slide from an idle position into an operating position and back. In order to provide precise abutment of the switch tongues against the stock rails, the slide chairs are provided with lubricants to minimize friction. This arrangement necessitates substantial consumption of lubricants, as well as a need for regular maintenance. In areas subject to freezing conditions, or particularly alternating freezing and thawing in a single day, there is a risk that the switch tongues will be immobilized by ice so that they must be heated before being operated.

In order to convert the sliding friction between the slide chair and the foot of the switch tongue into rolling friction, it is known to provide rolls. In the first attempts, the rolls were disposed such that the switch tongues were supported by the rolls even in the operating position. This resulted in overloading of the rolls, rendering them inoperable and moreover leaving them in a condition such that they interfered with the functioning of the switch. The next step was to provide the rolls only in regions not acted on by the switch tongues when the latter rested against the stock rails. Such a switch is described in Austrian Patent No. 375,697. Rolls are provided, disposed next to the switch tongues. To move the tongues from their operating position resting against a stock rail, the tongues are raised while rolling over the rolls, so that in each case the movement of the tongues passes through a stage of abutment against the rolls, whereas when the tongues rest against the stock rails they are supported on the customary slide chairs. The rolls themselves are rotatably mounted in their own roll blocks, which may be supported on the ties or the like via spring-loaded plates, plate springs, or the like. Exact vertical and lateral positioning of the roll blocks in relation to the bedplate can be accomplished by screwing to the baseplate, whereby lateral adjustment is accomplished by lateral shifting followed by screw fastening, and vertical adjustment by interposing shim-like intermediate pieces between the roll block and the baseplate. The quality of functioning of a switch of the type described is determined by the exact positioning of the rolls in the vertical and horizontal directions. Once the roll blocks are mounted, the positioning of the roll is essentially invariable, since, e.g., in order to change the horizontal position to a relevant small degree one would require the boring of additional holes in the wooden ties at short separations, causing the holes to merge and be ineffective. Attempts to reposition the roll block by inserting intermediate pieces between the wooden ties and the block can lead to premature damage of the ties and high consumption of ties. Thus with the known system exact positioning is at best difficult and gives rise to excessive time spent by maintenance personnel in the dangerous vicinity of the ties.

European OS No. 0,532,860 A1 discloses a switch in which the roll block is vertically and horizontally translatable. The holding means for the roll block comprises a vertical slot through which a threaded bolt is passed which is slidably disposed in a horizontal slot. In order to achieve horizontal and vertical positioning of the roll block it is necessary to loosen the bolt, move the block to the desired position, and then retighten the bolt. A disadvantage of this arrangement is that additional wedges or the like are required to achieve accurate positioning because, e.g. if the rolls are under load i.e. carry the switch tongues, in order to raise the rolls one must overcome the force of the switch tongues, namely by slightly raising the tongues themselves to allow functioning, i.e. position adjustment, of the rolls. The roll block is then fixed in position by tightening the bolt, in a friction-locking means of fastening. Such fastening means are not capable of withstanding high forces such as arise in rail transport; thus continual readjustments are required if the rolls are to function properly rather than have their function taken over by supplementary "slide chairs".

SUMMARY OF THE INVENTION

It is an object of the present invention to provide a switch wherein the switch tongues are not slid but rolled into and out of their operating positions, whereby the altitude and lateral position of the rolls can be accurately and durably set with little cost and effort, and whereby the labor required to convert existing switches to the invention is not great.

The inventive switch has as its point of departure the state of the art disclosed in European OS No. 0,532,860 A1 for rail transport employing stock rails and tongue rails (switch tongues), with the stock rails being removably but non-slidably affixed to foundation elements (e.g. ties, bedplates, tie grids, etc.), wherein support surfaces are provided for the switch tongues, at least on the regions of the ends of such tongues, for resting of said tongues against the stock rails, wherein at least one roll, particularly a cylindrical roll with a shaft, is disposed in the region of swing of the tongues, wherein the topmost point of the roll in a direction normal to the plane of the rails is at a higher level than the corresponding support surface (i.e. a supplementary slide chair or the like provided for the tongues), wherein when the switch tongues are in a position abutting against the stock rails, the roll presses against its associated switch tongue at a location below the topmost point of the roll, and when the switch tongues are in a position other than the position abutting against the stock rails the tongues can be supported by the rolls, further wherein the roll is spring-loaded in a direction normal to the plane of the tracks, is adjustably mounted in said normal direction and in said plane, and has its shaft disposed in the direction of extent of the stock rails; the inventive switch being characterized in that the ends of the shafts are mounted in holding structures such as to be adjustable in level or height, with at least one holding structure being capable of being held in place, with respect to the direction toward the stock rails, directly or indirectly via at least one spacing piece.

The holding of the tongue ends in position against the support surfaces of the relevant rolls when the tongues are positioned against the stock rails ensures accurate positioning o the tongues in their operating position. The adjustability of the level or height of mounting of the roll shaft ends in the roll holding structures ensures that, e.g., a roll block or the like, preferably comprised of a material resistant to weathering and corrosion, e.g. a nonferrous metal, can be attached to the bedplate element, so that the only components which need to be adjusted as to height are the shaft ends, not the heavier roll blocks or the like; this reduces the effort and cost of said level changes while at the same time enabling particularly accurate positioning. The fact that at least one holding structure can be held in place, with respect to the direction toward the stock rails, via at least one spacing piece, enables particularly accurate positioning of the roll with respect to the switch tongue, because the roll is pressed against the switch tongue, so that with respect to the one terminal position of the roll the holding structure need be moved against the switch tongue only by the distance such that the roll presses against the tongue in the proper position. Such a position may be that where, e.g. 30–60 degrees of the roll is subtended by the upper segment of the roll above the tongue support surface, thereby providing a suitable value of the lifting work for the switch tongue in order to make the transition from the operating position of the tongue against the stock rail to the rolling position of the tongue over the roll.

The holding structure for a shaft and may comprise a notch which is oriented transversely, particularly normally, to the track plane, which is open toward the roll, and which is at least partially closed in the downward direction. This provides particularly accurate positioning of the roll in the horizontal direction with respect to the stock rails and at the same time easy and simple vertical positioning of the shaft end(s).

The ends of the shafts may rest in the respective notches via intermediate pieces, whereby positioning of the shafts in the vertical direction is achieved which will not be disturbed even by large and abruptly applied loads.

The ends of the shafts, which may have a polygonally shaped cross section, preferably square, may rest on the intermediate pieces via only one surface. This provides particularly good force transmission conditions between the shaft ends and the intermediate pieces, whereby the deformation of the intermediate pieces, and thereby position changes of such pieces, are particularly small.

The intermediate pieces may have projections and recesses which interengage, particularly projections and recesses of frustoconical shape. This arrangement may effectively prevent the intermediate pieces from moving from their operating positions as a result of oscillating or vibrating stresses, and provides positive means for retaining the intermediate pieces in their operating positions.

The holding structures for at least one of the rolls may be spring-loadedly affixed to the bedplate, whereby the rolls can also execute the necessary vertical spring-loaded movement; such spring-loaded movement capability not only is needed to compensate for dimensional errors and tolerances in assembly but, particularly in the case of fixed track, enables spring-loaded yielding of the switch tongue in a manner similar to that of the stock rails.

The holding structure may be provided with an upwardly an downwardly adjustable adjusting screw or the like, which bears the shaft end, whereby particularly accurate positioning can be achieved, and the shaft ends can be positioned or raised in a single operation.

The roll-holding structure for at least one roll may be held in place in spring-loaded fashion in the direction toward the stock rail, whereby particularly good urging of the switch tongue against the stock rail by means of the roll is provided along with a reduction in the resistance presented to movement of the switch tongue.

The roll-holding structure may be provided with holding means for at least one roll which are affixed to the bedplate by means of plate springs, whereby particularly large vertical forces can be accommodated.

The roll-holding structure for at least one roll may be held in the direction toward the center of the tracks, via at least one plate spring which is engaged by a second spring element, to provide particularly easy adjustment when the system is installed or set up.

The ends of the plate springs remote from the roll-holding structure may each be disposed in a groove or the like oriented in the direction of the track plane, and the groove may be provided with a spring on the end thereof closest to the stock rail, which spring urges the plate spring toward the center of the tracks, whereby the plate spring can be adjusted by means of a replaceable spacer. This provides a particularly simple, easy, and accurate means of positioning the roll with respect to the switch tongue ends, in the direction transverse to the stock rails.

The roll-holding structure may have two blind recesses for accommodating the plate springs, whereby the springs can be easily positioned by inserting them into said recesses. This capability is particularly important in the context of the installing or adjusting the switch without disturbing normal train traffic, which installation process extends over an appreciable time period.

If the plate springs (which may be steel) engage the blind recesses in the interior of the roll-holding structure (which preferably comprise nonferrous metal) through the intermediary of electrically insulating inserts, e.g. of rubber, contact corrosion between the steel and nonferrous metal is avoided and in addition the material of the inserts can provide vibration damping.

The plate springs may be held in the roll-holding structure by clamp means, in which case additional mechanical processing (e.g. machining) of the plate springs is not required, and there is no compromise of the large surface area available for force transmission between the plate springs and the roll-holding structure.

The roll may be carried on the shaft via two roller bearings or ball bearings to provide particularly stable mounting of the roll. Lubrication may be long-term lubrication provided by the manufacturer.

The bearings may be sealed to the exterior in the region of the shaft and roll by means of oil-seal rings, which are preferably covered by a disc which engages a groove in the roll. Sealing of the antifriction bearings is thus provided of a type ordinarily employed only with high speed rotating shafts, and this ensures long service life. The supplementary covering by means of discs prevents mechanical damage to and soiling of the oil-seal rings, in both the region near the roll and in the particularly sensitive region near the shaft, and it does so in a simple and easy fashion.

BRIEF DESCRIPTION OF DRAWINGS

The invention will be described in more detail hereinbelow, with reference to the drawings.

DESCRIPTION OF PREFERRED EMBODIMENTS

Figure 1:
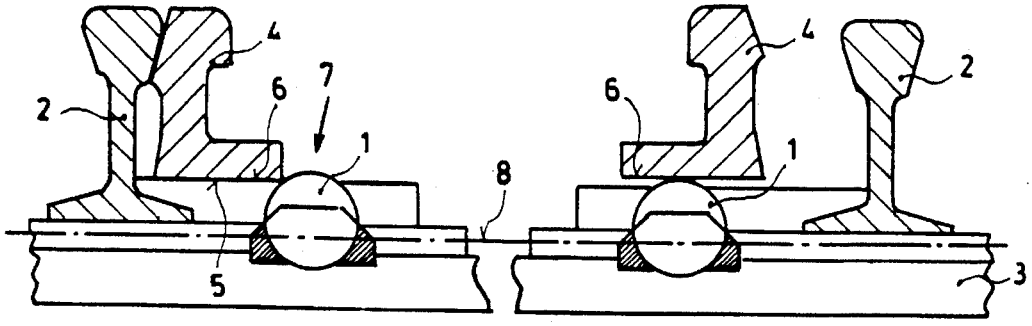
FIG. 1 is a schematic cross section of a rail switch.

In FIG. 1, stock rails 2 are fixed to a bedplate 3, which may be comprised of a wooden tie, one or more concrete slabs, a grid comprised of ties, or the like. Feet 6 of switch tongues 4 are supported on support surfaces 5 disposed therebeneath. When, during switching, a tongue 4 is moved out of the position in which it rests against the stock rail 2, (lefthand side of FIG. 1), one of two rolls 1 acts to raise the tongue 4, so that, as shown in the right side of FIG. 1, the foot 6 of the tongue cooperates with the circumference of the roll 1, whereby the tongue, being lifted, does not slide over the support surface 5 but rather it is lifted a distance above the surface 5 when the tongue moves a slight distance inwardly from its operating position. The lifting is provided by the fact that the topmost point 7 of the roll 1 is higher than the support surface 5. Ordinarily the raising is understood to be with respect to the track plane 8; in the case of straight track sections, the track plane is horizontal, but on curves it is inclined toward the interior of the curve, and in the case of a climb or descent the track plane inclines in the longitudinal direction of the track.

Figure 2:
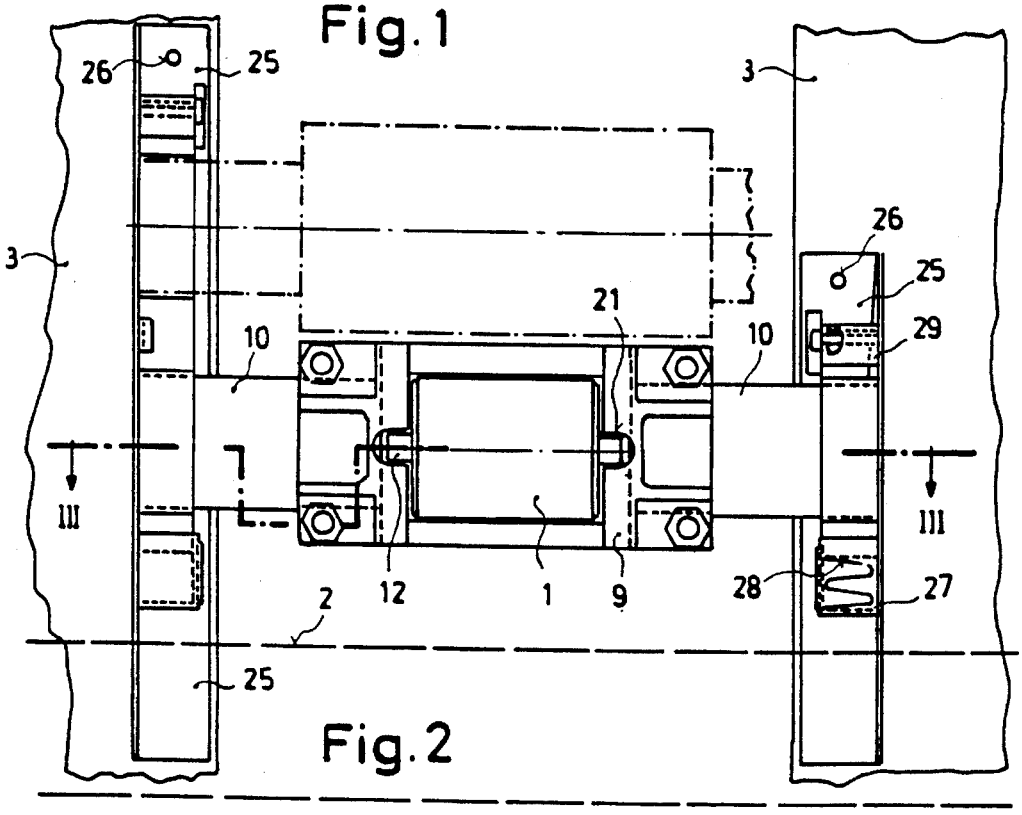
FIG. 2 is a plan view of a roll disposed between two ties.
Figure 3:
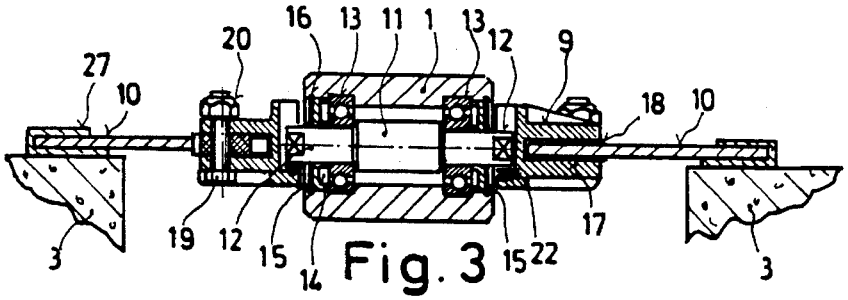
FIG. 3 is a cross section on line III—III of FIG. 2.
Figure 4:
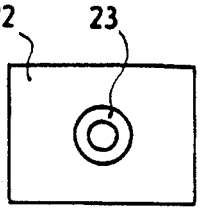
FIG. 4 is a plan view of an intermediate piece.
Figure 5:
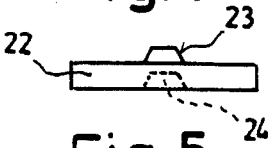
FIG. 5 is a side view of the intermediate piece of FIG. 4.

FIG. 2 shows a roll 1 mounted in a roll-holding structure 9 which in turn is attached to the bedplate 3 via plate springs 10. A plurality of such roll-holding structures with respective rolls may be employed, a second roll assembly being shown partially, in dashed lines. As seen particularly from FIG. 3, the roll has a shaft 11, the ends of which have a square cross section. The shaft carries the roll 1 via two ball bearings 13. The shaft is sealed by two oil seal rings 14, and an additional sealing disc 15 is provided exteriorly of each ring 14, which disc 15 engages a groove 16 in the roll 1. The roll-holding Structure 9 is comprised of a nonferrous metal which is resistant to weathering and corrosion. The springs 10 are comprised of steel, and are fixed in slot-shaped blind recesses 17 in the structures 9, via electrically insulating plastic inserts 18 which allow sliding. The springs 10 are fixed in the recesses 17 by clamp means comprising screws 19 and nuts 20. The nuts have plastic inserts of a known type, to fix them against rotation. The roll-holding structures 9 have recesses 21 (FIG. 2) to accommodate the shaft ends 2. Each recess 21 is in the form of a vertical notch or groove which is closed on its underside, and the shaft ends are carried on the bottom of the grooves, as with shim-like intermediate pieces 22. The intermediate pieces shown in FIGS. 4 and 5 each have a projection 23 and recess 24. The projection 23 in the form of a frustum of a cone can engage a corresponding recess 24 in an adjacent piece, whereby by simple insertion of the intermediate pieces 22 (which may have various thicknesses), e.g. by pushing or sliding them into place, it is possible to fix the height of the roll. Preferably the projection 23 extends downward, whereby the holding structure has a corresponding recess at the top, so that the surface of the square end of the shaft 12 can rest on the holding structure via the intermediate piece(s) 22. In lieu of such intermediate pieces, adjusting screws A1 may be provided.

Figure 6:
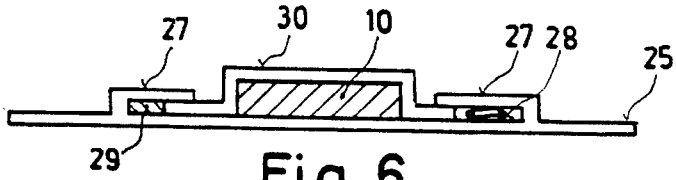
FIG. 6 is a sectional view of a fixing device which provides spring-loading.

The plate springs which are fixed in the roll-holding structure 9, are fixed to the bedplate elements 3 by holding elements 25 which in turn are affixed to the bedplate by screws 26. If desired, the holding elements 25 may also be welded to a part which carries the support surface 5. The holding elements have recesses or grooves 27 which extend approximately parallel to the stock rails 2. The ends of the plate springs 10 are disposed in the grooves 27 and may be urged by buffer springs 28 in the grooves 27 toward the center of the track system, and in this position said ends may be positioned by replaceable spacers 29 (FIG. 6). Although such a mounting of the plate springs is shown only on the right side of FIG. 2, such mounts may be provided for both plate springs 10, whereby the roll 1 in the situation corresponding to that of the left side of FIG. 1 is shifted to some degree underneath the switch tongue to provide an oblique supporting position. By appropriate selection of the spacers 29, a suitable fixing of the rolls against the force of the springs 28 in contact with the bottom of the tongue rail can be provided. If desired, after the roll is pressed into its appropriate position by a spacer 29, additional means may be employed to fix the plate springs 10 in the direction of and against the spring force of the springs 28. The spacers 29 are secured from falling out of the groove, by bending a part of the holding element. The fixing of the roll with respect to height can be accomplished easily by removing the roll 1 and inserting intermediate pieces 22 of various thicknesses, followed by re-mounting of the roll.

In the holding element 25 shown in FIG. 6, the groove 27 has two parts, and comprises two approximately U-shaped recesses for the ends of a yoke-shaped holding piece 30 which accommodates one end of the plate spring 10. To remove a plate spring held by a holding piece 30, the holding piece along with the plate spring must be slid against the force of the spring 28 so that the other end of the yoke 30 can be lifted out of the groove 27, following which the yoke is slid back in the other direction, and the end of the spring 10 can be removed from the holding piece 30. Such a holding arrangement enables the entire roll-holding structure 9 to be removed despite the fact that the holding element 25 is itself still mounted, e.g. welded, in place. Removal of structure 9 may be desired, for example, in order to adjust the height of the roll; and such removal is made possible even during normal use of the track, without major additional mechanical effort.

Generally, the roll-holding structure is set up in the following manner: the tongue rails lie against the stock rails, the rolls are moved toward the tongue rails to the extent that the rolls come to lie against the rails. Then the position-fixing on the bedplate elements is performed. Additional shifting of the rolls against the tongue rails can be accomplished by changing or adjusting the spacers 29 in the groove 27, in order to achieve a prestressing such that the rolls can no longer be rotated by hand. Under these conditions the rolls are pre-stressed in the upward direction and in the direction toward the stock rails.

I claim:

1. A railroad track switch comprising first and second stock rails and first and second swingable tongue rails, the stock rails being removably and non-slidably affixed to foundation elements, support surfaces for the tongue rails for supporting the first and second tongue rails in positions abutting against the first and second stock rails respectively, at least one roll for each tongue rail disposed in a swing path of the tongue rail, the roll having a topmost point at a higher level than the support surface of the tongue rail, said roll when the tongue rail is in a position abutting against a respective one of the stock rails pressing against the tongue rail at a point below the topmost point of the roll and when the tongue rail is in a switched position away from the respective stock rail, the tongue rail is supported on said roll, further said roll is mounted so as to be spring-loadedly movable in the direction transverse to the plane of the tracks, the roll having a roll shaft disposed in a direction of extent of the stock rails, the shaft having first and second shaft ends, mounting means mounting the shaft for adjustment of the shaft in a track plane of the stock rails and in a direction transverse to said plane, and first and second holding structures supported by the mounting means for the first and second shaft ends respectively, at least one of the holding structures having support means for altitude adjustment of the shaft end held therein, and a spacing piece in the mounting means for adjustably holding one of said holding structures in place in a direction towards the respective stock rail.

2. A railroad track switch according to claim 1, wherein the support means comprises a groove in said at least one of the holding structures to receive the shaft end and at least one intermediate piece for receipt in the groove to support the shaft end thereon whereby altitude adjustment of the shaft end is effected by selective use of the intermediate piece.

3. A railroad track switch according to claim 2, wherein the shaft end has a polygonally shaped cross section to rest on the intermediate piece via one flat surface of said shaft end.

4. A railroad track switch according to claim 2, including plural intermediate pieces for the shaft end with interfitting projections and recesses in the intermediate pieces.

5. A railroad track switch according to claim 1, wherein the holding structures are each carried at one end by a spring element having an opposite end carried by the mounting means.

6. A railroad track switch according to claim 5, wherein the mounting means includes a recess for receiving the opposite end of one of said spring elements between spacing piece at one end of the recess and a buffer spring at an opposite end of the recess.

7. A railroad track switch according to claim 6, wherein the buffer spring urges said opposite end of the spring element away from the stock rail.

8. A railroad track switch according to claim 5, wherein the spring elements comprises plate springs.

9. A railroad track switch according to claim 8, wherein said one end of each spring element is received in a blind recess in a respective holding structure.

10. A railroad track switch according to claim 8, wherein the holding structures each have two blind recesses for receiving the ends of the spring elements.

11. A railroad track switch according to claim 10, including electrically insulating inserts in the blind recessed receiving the spring ends.

12. A railroad track switch according to claim 5, including clamp means holding the ends of the spring elements in the holding structures.

13. A railroad track switch according to claim 1, including rolling bearings supporting the roll on the roll shaft.

14. A railroad track switch according to claim 13, including oil-seal rings for sealing outer ends of the rolling bearings.

15. A railroad track switch according to claim 14, including discs covering the oil-seal rings, said discs fitting in internal grooves in the roll.

* * * * *